US007478928B2

(12) United States Patent
Ushijima et al.

(10) Patent No.: US 7,478,928 B2
(45) Date of Patent: Jan. 20, 2009

(54) LIGHT SOURCE DEVICE

(75) Inventors: Shinichi Ushijima, Hyogo (JP); Atsuji Nakagawa, Hyogo (JP); Toshitaka Fujii, Hyogo (JP)

(73) Assignee: Phoenix Electric Co Ltd, Toyotomi-Cho Himeji-Shi Hyogo (JP)

( * ) Notice: Subject to any disclaimer, the term of this patent is extended or adjusted under 35 U.S.C. 154(b) by 0 days.

(21) Appl. No.: 11/560,408

(22) Filed: Nov. 16, 2006

(65) Prior Publication Data

US 2007/0242456 A1 Oct. 18, 2007

(30) Foreign Application Priority Data

Apr. 18, 2006 (JP) ..... 2006-114951

(51) Int. Cl.
*F21V 7/00* (2006.01)

(52) U.S. Cl. ..... 362/261; 362/344

(58) Field of Classification Search ..... 362/263, 362/262, 261, 416, 519, 344
See application file for complete search history.

(56) References Cited

U.S. PATENT DOCUMENTS 5,947,592 A * 9/1999 Barlow ..... 362/345
7,008,082 B2 * 3/2006 Meyer et al. ..... 362/344

* cited by examiner

*Primary Examiner*—Anabel M Ton
(74) *Attorney, Agent, or Firm*—Lucas & Mercanti, LLP

(57) ABSTRACT

To prevent scattering of broken pieces of a reflecting mirror even if a high pressure discharge lamp with a reflector bursts. A light source device according to the present invention is a light source device 10 that has an arc tube 1 and a reflector 2, and a cover glass 4 is externally fitted and fixed to the rear of the reflector 2 at opposite ends thereof with a gap S therebetween. With such a configuration, even if the arc tube bursts to cause a crack in the reflector, the cover glass prevents scattering of the broken pieces of the reflector.

4 Claims, 6 Drawing Sheets

LIGHT SOURCE DEVICE

BACKGROUND OF THE INVENTION

1. Field of the Invention

The present invention relates to a high pressure discharge lamp with a reflector that is suitable for use as a light source of a projector or the like.

2. Description of the Related Art

To achieve high luminance, recent discharge lamps raise the vapor pressure in the arc tube to 200 atmospheres or higher when they are lighted. Thus, if the temperature in the arc tube is raised by some cause, the pressure in the arc tube is also raised, and the arc tube becomes likely to burst. Such a high pressure discharge lamp typically has a concave reflecting mirror referred to commonly as reflector (referred to as reflector hereinafter). The reflector is typically made of borosilicate glass.

In the case where such a high pressure discharge lamp with a reflector is used in an apparatus, such as a liquid crystal projector and a projection television set, if the high pressure discharge lamps burst, there is a possibility that broken pieces of the arc tube hit the reflector to cause a crack or chip therein, or broken pieces of the reflecting mirror, in turn, damage other components of the apparatus.

Thus, there has been known a light source for a projection apparatus that has a reflector having an outer surface covered with a heat-resistant organic coating for preventing occurrence of a crack or chip in the reflector even if the lamp bursts (see the patent literature 1).

In addition, there has been known a method of using crystallized glass, which has high heat resistance and mechanical strength, as a shatter-proof reflector material, thereby minimizing the damage of any burst of the high pressure discharge lamp (see the patent literature 2).

In addition, there has been known a method of preventing fracture of the reflector in the case where the high pressure discharge lamp bursts by arranging a metal material between reflector base materials (see the patent literature 3).

[Patent literature 1] Japanese Patent Laid-Open No. 2000-47327

[Patent literature 2] Japanese Patent Publication No. 7-92527

[Patent literature 3] Japanese Patent Laid-Open No. 2004-354425

Even if a heat-resistant organic coating is formed as described in the patent literature 1, if the heat-resistant organic coating is made of a fluorine-based resin, it can resist only about 260 degrees Celsius. Thus, the rated power of the lamp is limited to about 200 W at the most. On the other hand, if the heat-resistant organic coating is a polyimide-based coating, the heat resistance is improved to about 400 degrees Celsius. However, the polyimide-based resin is expensive, so that there is a possibility that the manufacture cost relatively increases.

It is said that, if crystallized glass is used as described in the patent literature 2, the brightness is compromised because the crystallized glass is inferior to borosilicate glass in inner surface precision. In addition, the crystallized glass is more expensive than the inexpensive borosilicate glass, so that there is a possibility that the manufacture cost relatively increases.

If a metal material is used as described in the patent literature 3, infrared light once transmitted to the rear of the reflector base material is emitted toward the front again to damage not only resin parts of the optical unit but also optical parts (a lens, a fly's eye lens, a light pipe or the like).

SUMMARY OF THE INVENTION

The present invention has been devised in view of the circumstances described above, and a main technical object thereof is to prevent scattering of broken pieces of a reflecting mirror even if a high pressure discharge lamp with a reflector bursts.

A light source device according to the present invention is a light source device 10 that comprises an arc tube 1 and a reflector 2, and a cover glass 4 is externally fitted and fixed to the rear of the reflector 2 at opposite ends thereof with a gap S therebetween.

With such a configuration, even if the arc tube bursts to cause a crack in the reflector, the cover glass prevents scattering of the broken pieces of the reflector.

In this case, the thickness of the reflector 2 is preferably reduced to decrease the temperature difference between the inner surface and the outer surface. In a conventional case where no cover glass is provided, the thickness of the reflector 2 has to be increased in order to increase the strength of the reflector 2. However, this leads to an increase in temperature difference between the inner surface, that is, the surface facing the arc tube, and the outer surface, thereby increasing the probability of occurrence of a crack. However, the cover glass 4 provides adequate heat resistance and mechanical strength, and as a result, the thickness of the reflector 2 can be reduced. In the case where the reflector is made of borosilicate glass, the thickness of the reflector can be reduced to 3.5 mm or less for the high pressure discharge lamp having a rated power of 300 W.

Furthermore, a reflecting film that selectively reflects visible light may be formed on an inner surface of the cover glass 4. Here, the phrase "selectively reflects visible light" means that substantially only visible light is reflected, and light other than visible light, such as infrared light, is not reflected. This can be easily realized by forming a multilayer film on the inner surface of the reflector. Here, the "visible light" refers to light having a wavelength within about 380 nm to 780 nm, and the "infrared light" refers to light having a wavelength longer than about 780 nm.

In this case, if the reflector 2 is an ellipsoidal reflecting mirror, the cover glass 4 is also an ellipsoidal reflecting mirror, and the reflector 2 and the cover glass 4 are preferably arranged in such a manner that primary focuses f1 and F1 thereof coincide with a luminous point P of the arc tube 1, and points at which light is focused by the reflector 2 and the cover glass 4 also coincide with secondary focuses f2 and F2 thereof. Alternatively, if the reflector 2 is a parabolic reflecting mirror, the cover glass 4 also has a parabolic surface, and the reflector 2 and the cover glass 4 are preferably arranged in such a manner that focuses f3 and F3 thereof coincide with a luminous point P of the arc tube 1.

With such a configuration, the light not reflected from the reflector 2 but transmitted therethrough is reflected from the cover glass 4 and collected again at the secondary focus of the reflector. Thus, light which would otherwise be wasted is reused, so that the utilization efficiency of light is improved.

According to the present invention, even if the arc tube bursts, and broken pieces of the arc tube hit the reflector, the reflector is not likely to become cracked or chipped. Even if the reflector becomes cracked, the cover glass reduces the possibility of scattering of broken pieces of the reflector and thus the possibility of damage to the device.

In addition, since the cover glass has a reflecting film, and the position of attachment thereof is adjusted, the utilization efficiency of light is improved.

BRIEF DESCRIPTION OF THE DRAWINGS

FIG. 1(*b*) is a left-side view of the light source device 10;

FIG. 2(*b*) is an enlarged cross-sectional view showing a positional relationship between a reflector 2 and a cover glass 4;

FIG. 3(*b*) is a cross-sectional view of the reflector 2 with x and y coordinate axes;

FIG. 4(*b*) is a left-side view of the cover glass 4;

FIG. 4(*c*) is a cross-sectional view of the cover glass 4 (that is, a cross-sectional view taken along the line A-A in FIG. 4(*a*)) with x and y coordinate axes;

DETAILED DESCRIPTION OF THE PREFERRED EMBODIMENTS

First Embodiment

Figure 1A:
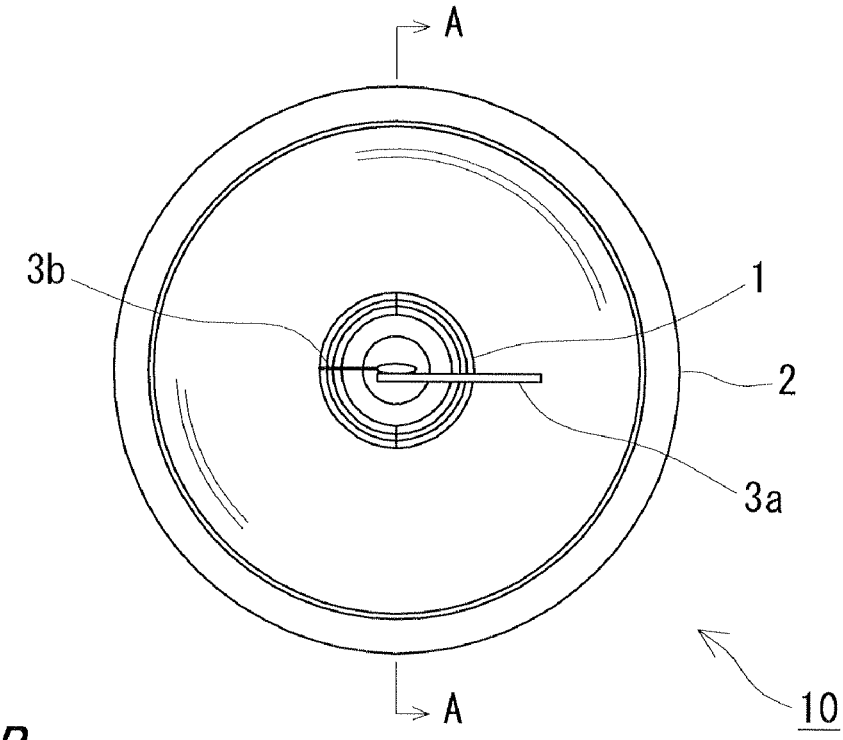
FIG. 1(*a*) is a front view of an exemplary light source device 10 according to the present invention.
Figure 1B:
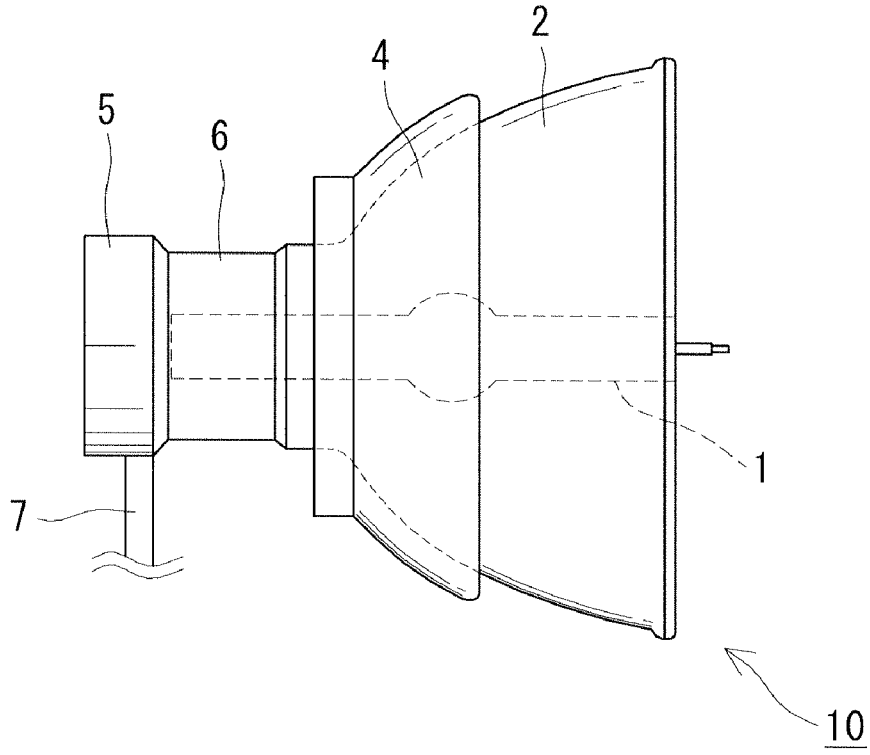

FIG. 1(*a*) is a front view of an exemplary light source device 10 according to the present invention. The light source device 10 has an arc tube 1 and a reflector 2. The arc tube 1 contains 0.2 mg/mm$^3$or more mercury and has a pair of electrodes opposed to each other at the center thereof. In addition, the arc tube 1 has a lead wire 3*a* and a trigger wire 3*b*. When a predetermined amount of electrical power is applied to the electrodes of the arc tube 1, the electrical discharge starts, and light is emitted. The arc tube 1 of the high pressure discharge lamp according to this embodiment may be a direct-current type or an alternating-current type.

The reflector 2 may be made of inexpensive borosilicate glass (although crystallized glass can be used, it is expensive). The borosilicate glass is known to be strained and crack because of a thermal stress if the temperature difference between the inner surface and the outer surface of the borosilicate glass exceeds 180 degrees Celsius. It is considered that a thickness of about 3.5 mm can provide a temperature difference equal to or lower than 180 degrees Celsius. (For information, it is said that a thickness of 3.6 mm provides a temperature difference about 10 degrees Celsius greater than the specification.) In this regard, the reflector 2 has to have a thickness that prevents the occurrence of a strain and a crack caused by thermal stress therein. As for the lower limit, the thickness of the reflector 2 has to be about 1.8 mm or more, from the viewpoint of glass forming. In any case, it is essential only that the reflector has a thickness that prevents the occurrence of a crack due to a strain caused by thermal stress.

The reflector 2 has a multilayer film formed on the inner surface thereof, which serves as an antireflection film. Thus, of the light emitted by the arc tube 1, about 95% to 98% of visible light is reflected, and about 95% of infrared light is transmitted. The percentage representation is not based on the whole emitted light as 100% but on the light in each relevant area as 100% (the same holds true for the following description). The inner surface of the reflector constitutes a concave reflecting mirror, and the curved surface may be an ellipsoid of revolution or a paraboloid of revolution depending on the application and is not limited to a particular one in this embodiment.

Figure 2A:
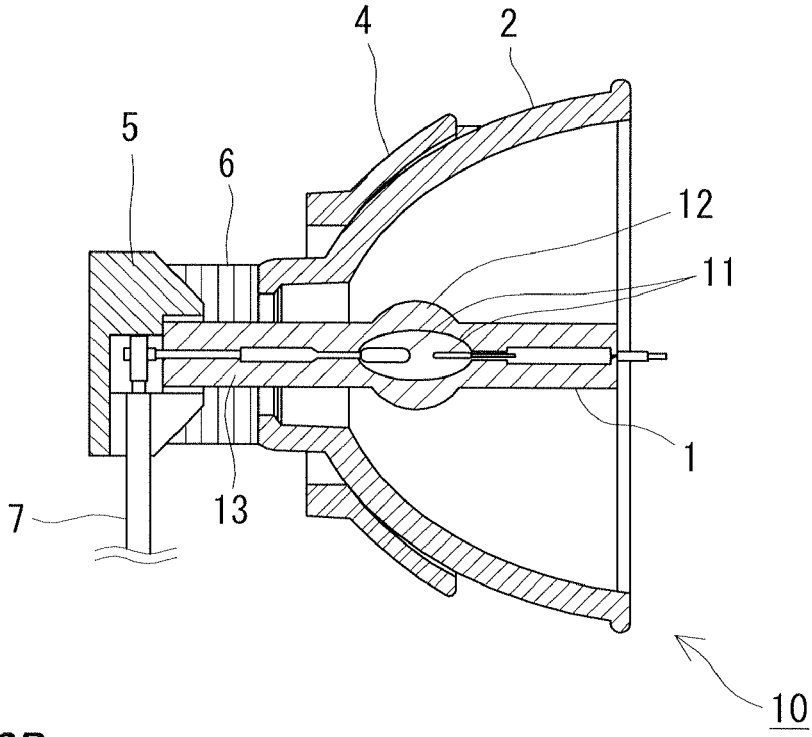
FIG. 2(*a*) is a cross-sectional view taken along the line A-A in FIG. 1(*a*)
Figure 2B:
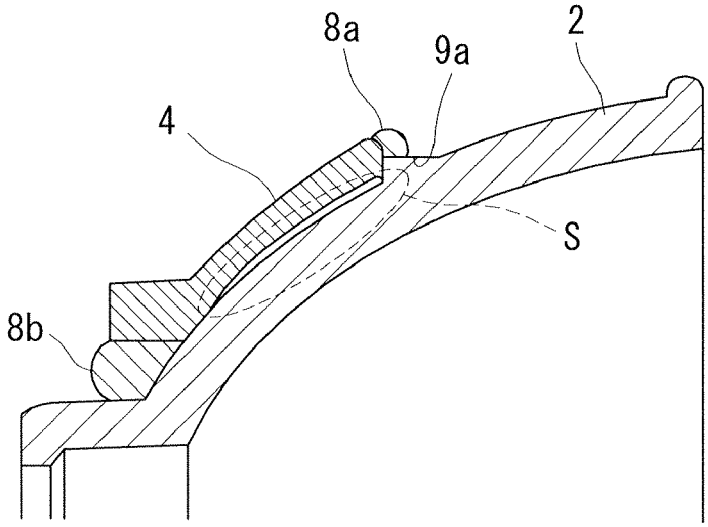

FIG. 1(*b*) is a left-side view of the light source device 10. FIG. 2(*a*) is a cross-sectional view taken along the line A-A in FIG. 1(*a*). As shown in these drawings, a member referred to as "cover glass 4" is externally fitted and fixed to the rear of the reflector 2 of the light source device 10 according to the present invention. The arc tube 1 is composed of a light-emitting part 12 having a pair of electrodes 11 opposed to each other and a sealing part 13.

The cover glass 4 can be made of any hard glass that can be processed into a reflector shape, and the material thereof is not limited to a particular one. The arc tube 1 is supported by a lamp holder 5 and covered with the reflector 2 and the cover glass 4. The arc tube 1 and the lamp holder 5 are bonded to the reflector 2 with an adhesive 6, and electrical power is supplied to the arc tube 1 via an electric wire 7 and the lead wire 3*a*.

FIG. 2(*b*) is an enlarged cross-sectional view showing a positional relationship between the reflector 2 and the cover glass 4. As shown in this drawing, the cover glass 4 is not completely in intimate contact with the reflector 2, and a small gap S is formed between the cover glass 4 and the reflector 2 depending on the difference in curvature therebetween. Even if a burst of the arc tube exerts a great mechanical impact on the reflector 2, the gap S serves as a buffering space to prevent the impact from being transferred to the cover glass 4.

The means of fixing the reflector 2 and the cover glass 4 is not limited to a particular one. For example, the reflector 2 and the cover glass 4 can be fixed using a heat-resistant inorganic adhesive.

Reference numerals 8*a* and 8*b* in FIG. 2(*b*) denote a heat-resistant inorganic adhesive. However, since the gap S serves as a buffering space as described above, it is not preferred that the adhesive is applied into the gap S. In addition, for positioning the reflector 2 and the cover glass 4, the reflector 2 has three positioning protrusions 9 (9*a*, 9*b*, 9*c*) equally spaced apart from each other on the back surface thereof. While the protrusions 9 are not essential in this embodiment, the protrusions are essential in a second and a third embodiment described later in order to facilitate relative positioning of the reflector 2 and the cover glass 4. The configuration of the positioning protrusions is not limited to that described above, and other configurations may be used. For example, a positioning protrusion that extends along the entire periphery of the reflector 2 may be formed. According to this embodiment, there is no need to use the cover glass as a secondary reflecting mirror, the necessity for the protrusions 9 is relatively small.

Second Embodiment

With regard to the second and the third embodiment, there will be described configurations in which a cover glass serves as a secondary reflecting mirror, that is, the light scattered to the rear of a reflector is reflected from the surface of a cover glass 4 and collected again. According to the second and the third embodiment, the cover glass 4 has, on a surface thereof, a multilayer film that selectively reflects visible light and transmits infrared light. The multilayer film functions as a reflecting film.

Figure 3A:
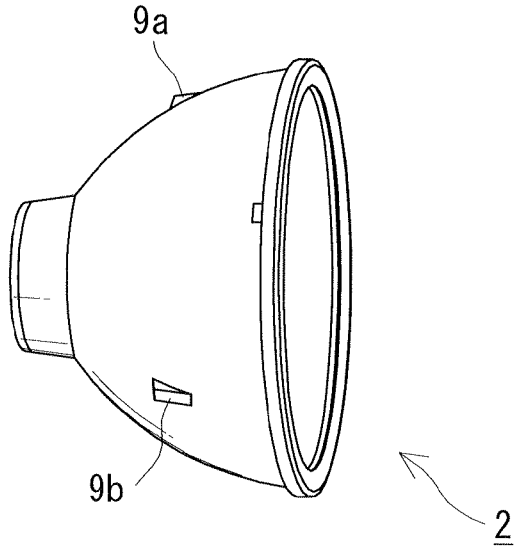
FIG. 3(*a*) is a perspective view of a reflector 2 used in a light source device according to a second embodiment of the present invention.
Figure 3B:
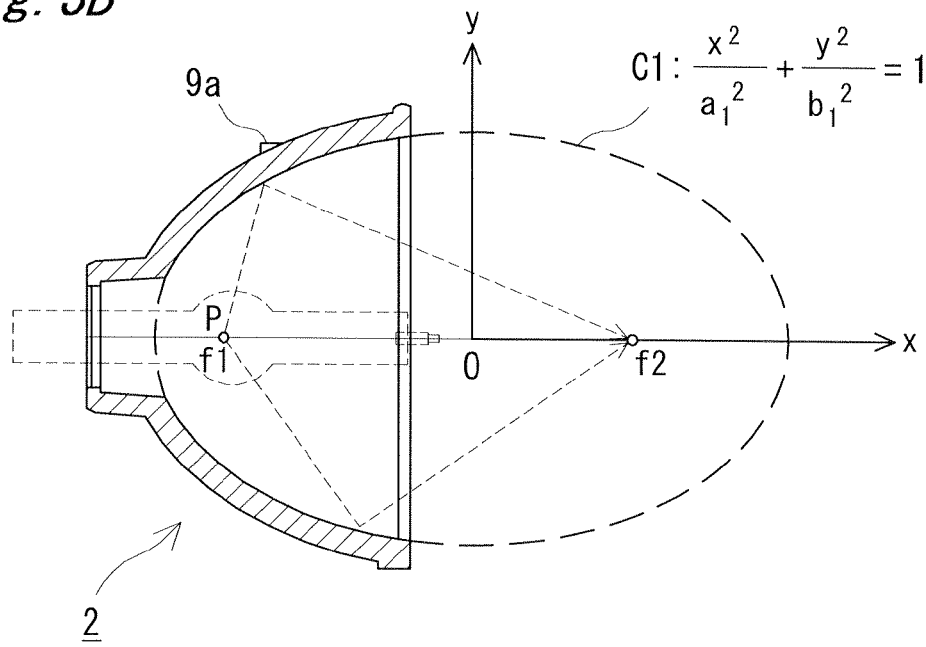

FIG. 3(*a*) is a perspective view of a reflector 2 used in a light source device according to this embodiment. Protrusions 9*a* and 9*b*, which are shown in FIG. 2(*b*), can be seen (a protrusion 9*c* is behind the reflector and is not shown). The protrusions 9 allow the center axes (optical axes) of the reflector 2 and the cover glass to be aligned with each other with reliability when the cover glass is attached to the rear of the reflector 2. In the case where the cover glass 4 is used as a secondary reflecting mirror, the positional relationship between the cover glass and the reflector is important. Such positioning protrusions 9 allow precise and quick assembly of the reflector 2 and the cover glass 4.

With regard to the second embodiment, a case where the reflector is a concave reflecting mirror in the shape of an ellipsoid of revolution (that is, the reflector is an ellipsoidal reflecting mirror) will be described. In this case, the inner surface of the cover glass is also in the shape of an ellipsoid of revolution, and the shape of and the positional relationship between the reflector and the cover glass are determined as described below.

1. Shape of Reflector

First, the shape of the reflector 2 will be described.

FIG. 3(*b*) is a cross-sectional view of the reflector 2 with x and y coordinate axes. The coordinates are set so that the optical axis coincides with the x axis. The inner curved surface of the reflector 2 is in the shape of an ellipsoid of revolution, and the reflector 2 is elliptical in a cross section taken along the optical axis.

Supposing that a primary focus and a secondary focus of the ellipse are denoted by f1 and f2, respectively, the x-intercept and the y-intercept of the elliptical curve C1 are 36 mm and 22.6274 mm, respectively. In other words, the elliptical curve C1 is represented by the following elliptical curve Formula 1.

$$\frac{x^2}{a1^2} + \frac{y^2}{b1^2} = 1 \qquad \text{[Formula 1]}$$

The coordinates of the two focuses f1 and f2 are (−28.0, 0) and (28.0, 0), respectively. The positional relationship between an arc tube 1 and the reflector 2 is determined in such a manner that the brightest point P of the arc tube 1 (referred to as "luminous point") coincides with the primary focus.

The light reflected from the reflector 2, which constitutes a part of the elliptical curve, is collected at the secondary focus (f2), and thus, an optical element, such as a color wheel, is disposed at this position.

2. Shape of Cover Glass and Positional Relationship Thereof with Respect to Reflector Next, the shape of the cover glass 4 and the positional relationship thereof with respect to the reflector will be described.

Figure 4A:
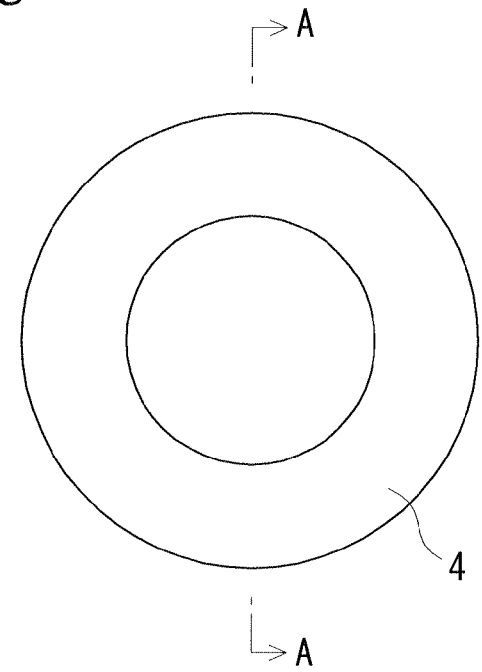
FIG. 4(*a*) is a front view of a cover glass 4.
Figure 4B:
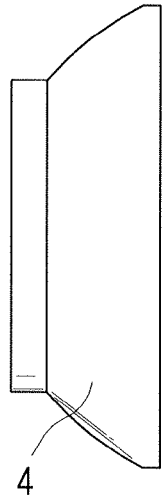
Figure 4C:
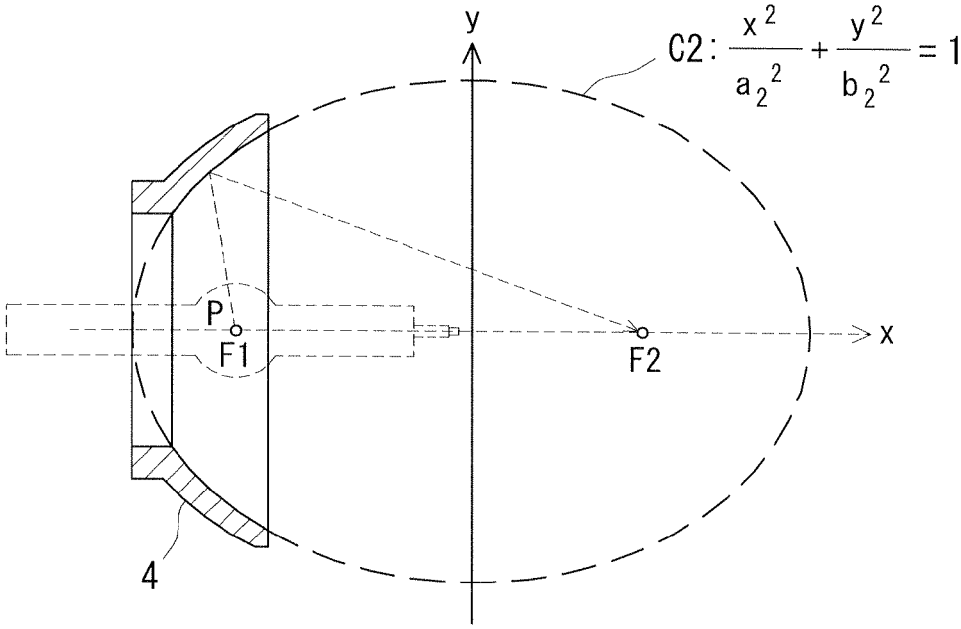

FIG. 4(*a*) is a front view of the cover glass 4, and FIG. 4(*b*) is a left-side view of the cover glass 4. As described above, the cover glass 4 is disposed at the rear of the reflector 2 and fixed to the reflector 2 with the front edge face thereof abutting against the positioning protrusions 9*a*, 9*b* and 9*c* on the reflector 2.

FIG. 4(*c*) is a cross sectional view of the cover glass 4 (that is, a cross sectional view taken along the line A-A in FIG. 4(*a*)) with x and y coordinate axes. In the case where the reflector 2 has a surface in the shape of an ellipsoid of revolution and is elliptical in a cross section taken along the optical axis as shown in FIG. 3(*b*), the inner curved surface of the cover glass 4 is also in the shape of an ellipsoid of revolution, and the cover glass 4 is elliptical in a cross section taken along the optical axis. In addition, the cover glass 4 is arranged in such a manner that the optical axis (x axis) thereof coincides with the optical axis of the reflector 2.

Supposing that a primary focus and a secondary focus of the ellipse are denoted by F1 and F2, respectively, the x-intercept and the y-intercept of the elliptical curve C2 are 38.5 mm and 26.4 mm, respectively. In other words, the elliptical curve C2 is represented by the following elliptical curve Formula 2.

$$\frac{x^2}{a1^2} + \frac{y^2}{b1^2} = 1 \qquad \text{[Formula 2]}$$

The coordinates of the two focuses F1 and F2 are (−28.0, 0) and (28.0, 0), respectively. The positional relationship between the arc tube 1 and the cover glass 4 is determined in such a manner that the brightest point P of the arc tube 1 (referred to as "luminous point") coincides with the primary focus. The light reflected from the cover glass 4 is collected at the secondary focus F2.

Figure 5:
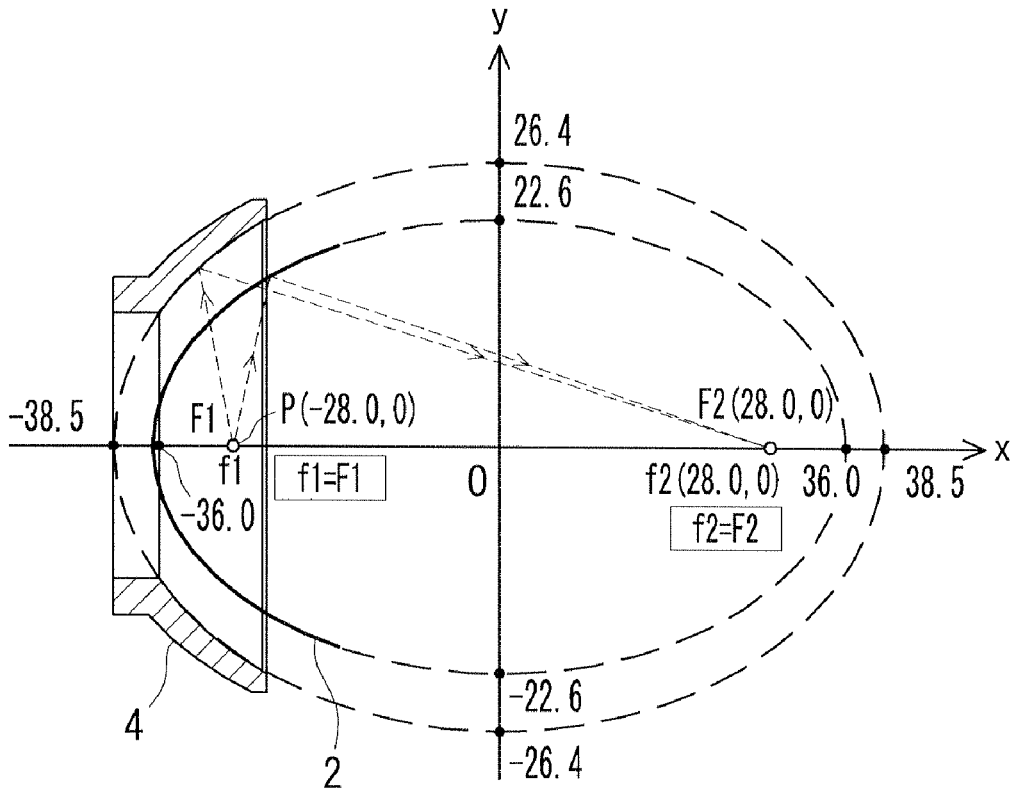
FIG. 5 is a diagram showing elliptical curves of the reflector 2 and the cover glass 4 superimposed on each other.

FIG. 5 is a diagram showing the elliptical curves of the reflector 2 and the cover glass 4 superimposed on each other (for convenience, the contour of the reflector is not shown). If the reflector 2 and the cover glass 4 are arranged in this positional relationship, light that is not reflected from the reflector 2 but transmitted therethrough is reflected from the cover glass 4 and collected at the secondary focus F2. In view of this, it can be said that the reflector 2 is used as a "primary reflecting mirror", and the cover glass 4 is used as a "secondary reflecting mirror". Since the secondary focus F2 of the cover glass 2 coincides with the secondary focus of the reflector 2, the utilization efficiency of light is improved. According to a calculation, the reflector (primary reflecting mirror) transmits about 2% to 5% of visible light and about 95% of infrared light to the rear thereof. If the cover glass 4, which serves as the secondary reflecting mirror, has a multilayer film that reflects only the visible light, the about 2% to 5% of visible light, which is conventionally wasted, can be collected again at the secondary focus of the reflector 2. Thus, the utilization efficiency of light can be improved by about 2% to 5%.

For front projectors, rear projection television sets and the like, which are used for several thousands of or several tens of thousands of hours, even the 2% to 5% of visible light can cause a temporal change (carbonization or the like) of a resin part forming an optical unit, such as a lamp house and a color wheel, or a fire due to heating of the resin part. However, these problems can be prevented, and the utilization efficiency of light can be improved.

The numerical values in the description of this embodiment are intended only for the illustrative purposes, and, of course, the present invention is not limited thereto. As described above with regard to this embodiment, the values a1, b1, a2 and b2 in the elliptical curve Formulas 1 and 2 are preferably selected so that both the primary focuses and the secondary focuses coincide with each other.

The light transmitted through the reflector and incident on the cover glass travels along slightly different paths depending on the refractive index of the reflector. By taking this into consideration, the reflector and the cover glass can be more precisely positioned.

Third Embodiment

According to the second embodiment described above, the reflector 2 and the cover glass 4 have a surface in the shape of an ellipsoid of revolution. Next, a case of a paraboloid of revolution (that is, an embodiment in which a reflector and a cover glass are parabolic reflecting mirrors) will be described. Whereas an elliptical curve has two focuses, a parabola has only one focus. Thus, a reflector 2 and a cover glass 4 are arranged in such a manner that the focuses thereof coincide with the luminous point P (the brightest point of an arc tube 1).

Figure 6:
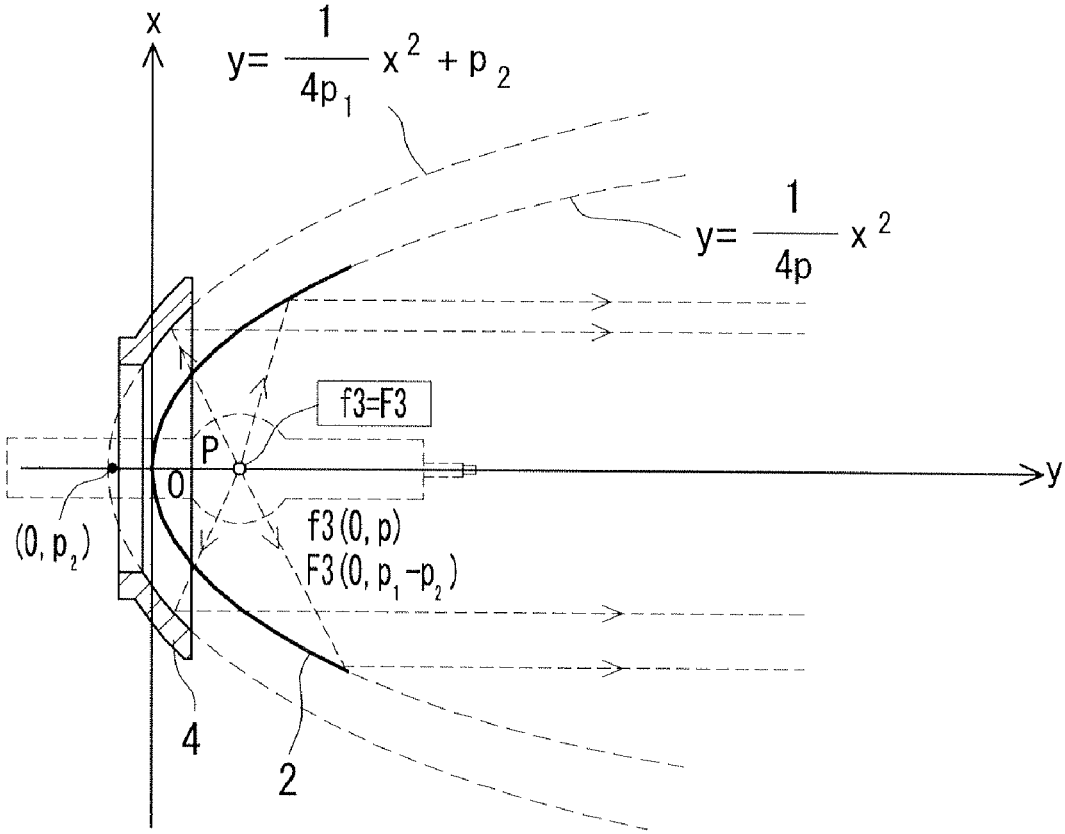
FIG. 6 shows a positional relationship between the reflector 2 and the cover glass 4 arranged with the focuses thereof coinciding with each other.

FIG. 6 shows a positional relationship between the reflector 2 and the cover glass 4 arranged with the focuses coinciding with each other (for convenience, the contour of the reflector is not shown). This configuration is particularly suitable for a liquid crystal projector or the like.

The focuses f3 (0, p) and F3 (0, $p_2-p_1$) of two parabolas represented by the following formulas coincide with each other (where $p_2$ represents a negative value).

$$y=(1/4p)*x^2 \quad \text{(Formula 3)}$$

$$y=1/(4p_1)*x^2+p_2 \quad \text{(Formula 4)}$$

The reflector 2 and the cover glass 4 are arranged in such a manner that the reflector 2 matches with a part of the paraboloid of revolution whose cross section taken along the optical axis is expressed by the Formula 3, and the cover glass 4 matches with a part of the paraboloid of revolution whose cross section taken along the optical axis is expressed by the Formula 4.

With such a configuration, a slight amount of light transmitted to the rear of the reflector 2 is reflected again by the cover glass, so that the utilization efficiency of light is improved.

The light transmitted through the reflector and incident on the cover glass travels along slightly different paths depending on the refractive index of the reflector. By taking this into consideration, the reflector and the cover glass can be more precisely positioned.

In the second and the third embodiment described above, the cover glass 4 has a multilayer film, which serves as a secondary reflecting mirror. However, even if the cover glass does not serve as the secondary reflecting mirror as in the first embodiment, arranging the cover glass 4 at the rear of the reflector 2 is effective to some extent for the prevention of cracking or the like of the reflector 2. Thus, for example, in the case where the cover glass 4 has no multilayer film and is made of simple transparent glass or the like, the cover glass 4 is not used as the secondary reflecting mirror, so that there is no need to take into consideration the positional relationship between the reflector 2 and the cover glass 4.

The light source device according to the present invention can minimize the occurrence of cracks or chips in the reflector even if the arc tube bursts and thus can prevent damages to the device.

In addition, by arranging the cover glass so that the light transmitted to the rear of the reflector is reflected again in a predetermined direction as described above with regard to the second and third embodiments, the utilization efficiency of light can be further improved.

As described above, the present invention has an exceedingly high industrial applicability.

What is claimed is:

1. A light source device, comprising:

an arc tube of a high pressure discharge lamp; and a reflector, which is in a suitable thickness to prevents cracking due to thermal stresses, wherein a cover glass is externally fitted and fixed to the rear of the reflector at opposite ends thereof with a buffering space gap therebetween.

2. A light source device, comprising:

an arc tube; and a reflector, wherein a cover glass is externally fitted and fixed to the rear of the reflector at opposite ends thereof with a gap therebetween, and a reflecting film that selectively reflects visible light is formed on an inner surface of said cover glass.

3. The light source device according to claim 2, wherein in the case where said reflector is an ellipsoidal reflecting mirror, the cover glass is also an ellipsoidal reflecting mirror, and the reflector and, the cover glass are arranged in such a manner that primary focuses thereof coincide with a luminous point of said arc tube, and points at which light is focused by said reflector and said cover glass also coincide with secondary focuses thereof.

4. The light source device according to claim 2, wherein in the case where said reflector is a parabolic reflecting mirror, the cover glass is also a parabolic reflecting mirror, and the reflector and the cover glass are arranged in such a manner that focuses thereof coincide with a luminous point of the arc tube.

* * * * *